United States Patent [19]

Frawley

[11] Patent Number: 4,757,297

[45] Date of Patent: Jul. 12, 1988

[54] CABLE WITH HIGH FREQUENCY SUPPRESION

[75] Inventor: Lanny J. Frawley, St. Charles, Ill.

[73] Assignee: Cooper Industries, Inc., Houston, Tex.

[21] Appl. No.: 932,184

[22] Filed: Nov. 18, 1986

[51] Int. Cl.[4] ..... H01C 3/06

[52] U.S. Cl. ..... 338/214; 174/35 R; 174/35 SM; 174/36

[58] Field of Search ..... 358/214; 333/79; 174/35 R, 35 SM, 35 CE, 35 TS, 36

[56] References Cited

U.S. PATENT DOCUMENTS

| | | | |
|---|---|---|---|
| 1,586,884 | 6/1926 | Elmen . | |
| 1,672,979 | 6/1928 | Fondiller . | |
| 1,984,526 | 12/1934 | Given | 123/148 |
| 2,319,744 | 5/1943 | Mougey | 179/78 |
| 2,322,773 | 6/1943 | Peters | 174/119 |
| 2,790,053 | 4/1957 | Peterson | 201/63 |
| 3,087,007 | 4/1963 | Jachimowicz | 174/110 |
| 3,215,768 | 11/1965 | Murphy | 174/36 |
| 3,433,891 | 3/1969 | Zysk et al. | 174/120 |
| 3,454,907 | 7/1969 | Rimsha | 333/79 |
| 3,651,244 | 3/1972 | Silver et al. | 174/36 |
| 3,683,309 | 8/1972 | Hirose | 338/214 |
| 3,748,369 | 7/1973 | Durakis et al. | 174/36 |
| 3,870,987 | 3/1975 | Wiley et al. | 338/214 |

*Primary Examiner*—E. A. Goldberg
*Assistant Examiner*—M. M. Lateef
*Attorney, Agent, or Firm*—Fitch, Even, Tabin & Flannery

[57] ABSTRACT

An ignition cable which applies ignition current from a power source to a spark plug of a spark ignited internal combustion engine while attenuating radio frequency currents. An inner elongated electrically conductive metallic core made of a high permeability material has an electrically semiconductive layer disposed thereabout and in intimate contact therewith. Insulation surrounds the semiconductive layer. Direct current is effectively and preferentially conducted by the inner core to provide ignition current, while high frequency currents are crowded by the skin effect into the semiconductive layer, where they are damped by the resistance thereof.

13 Claims, 1 Drawing Sheet

CABLE WITH HIGH FREQUENCY SUPPRESION

The present invention relates generally to electrical cables, and more particularly to an ignition cable that attenuates high frequency currents.

BACKGROUND OF THE INVENTION

In the ignition system of an spark ignited internal combustion engine, high voltage is applied by ignition cables to spark plugs. Energy is supplied from a battery to build up energy in the magnetic field of an ignition coil. Breaker points are opened and closed by operation of a cam shaft driven by the engine to control the flow of current to the coil from the battery. Upon interruption of the flow, the ignition coil produces a high voltage across the gap in a respective spark plug selected by the distributor to cause ignition in a respective cylinder as the magnetic field in the ignition coil collapses. The high voltage breaks down the dielectric in the gap, resulting in a spark that ignites the air-fuel mixture. The sparks are accompanied by violent surges of current in the ignition cable. Unless suppression means are provided, the ignition cable acts as an antenna and radiates a broad spectrum of frequencies caused by the sparking, causing interference with radio reception and with the proper operation of other electronic equipment. The FCC requires automobile manufacturers to meet SAE standards for allowable automobile electrical noise. The ignition system contributes a significant amount of this electrical noise, and, therefore, it is important that an ignition cable with good suppression means be used in this system.

Some ignition cable designs have suppressed interfering frequencies by using semiconductive cables or high resistance cables that attenuate interfering frequency currents. A drawback of these cables is that they also offer high resistance to the desired ignition current wasting useful power and inhibiting the sparking current. Furthermore, the current attenuation causes cable heating that results in premature aging, oxidation, and corrosion.

Rimsha, U.S. Pat. No. 3,454,907, discloses a radio frequency attenuating cable that preferentially conducts direct current. The Rimsha cable has an inner core made of copper clad with a cylindrical conductor of nickel. About this inner core is wound a high permeability metal wire which is heat fused to the nickel cladding. The object of this conductor design is to attenuate high frequencies arising from outside the system, as to isolate an electroexplosive device from an electromagnetic field as might arise from a nuclear explosion. Direct current is preferentially passed through the more conductive inner core while alternating current is crowded to outside surface by the skin effect. Skin effect occurs whenever alternating current is applied to a conductor, and the crowding increases with increases in frequency. The skin effect results from the greater impedance of the interior of the conductor with increase in frequency, occasioned by the greater inductance of the interior. As disclosed in Rimsha, the effective resistance of a conductor increases with frequency due to the skin effect, as the high frequency current is crowded into a smaller cross section. In Rimsha, the alternating current is crowded to the outer high permeability layer where it is attenuated. However, being metallic, the layer provides but limited damping.

SUMMARY OF THE INVENTION

The present invention generally comprises an electrical cable combining the best features of semiconductive cables, and the skin effect utilized by Rimsha. That is, it provides a conductive metallic inner core of high permeability which utilizes the skin effect to crowd high frequency currents into a surrounding semiconductive layer that provides relatively high resistance for damping any high frequency currents. Although the skin effect alone provides a relatively high impedance at high frequencies that limits high frequency currents and provides some damping from the effectively greater resistance, the present invention provides additional damping of the high frequency currents, dissipating the high frequency energy as heat to eliminate radiation as might interfere with external electronic devices, such as in radio reception.

The ignition cable specifically comprises an inner elongated electrically conductive metallic core made of a high permeability material with an electrically semiconductive layer disposed about and in intimate contact with the inner core. Insulation surrounds the semiconductive layer. This cable design is preferably such that for direct current and relatively low frequency current the impedance of the inner core is lower than impedance of the semiconductive layer so that the direct current necessary for ignition is conducted readily, while for high frequency current the impedance of the inner core is effectively increased to be greater than the impedance of the semiconductive layer. Therefore, the inner core has an impedance at radio frequencies, for example, that is high relative to its direct current resistance, which is negligible, while the semiconductive layer has a resistance that is high relative to the resistance of the inner core for direct current and an impedance that is low relative to the impedance of the inner core at radio frequencies. Thus, direct current is effectively and preferentially conducted by the inner core to provide ignition current with little power loss, and radio frequency currents are crowded into the semiconductive layer where they are damped, being converted into heat by the resistance thereof, to reduce radio frequency interference. Furthermore, because the inner layer is a metallic conductor, the cable withstands vibration and is resistant to heat, oxidation and corrosion.

In addition, the cable is designed such that it can be terminated in the field by the user. The user first strips off the outer insulation and semiconductive layer. The inner core in then folded against the unstripped cable. A terminal is put around the folded over core, and the assembly is crimped together to complete this simple termination process. Thus, the ignition cable can be sold in semicustom ignition sets and used for aftermarket applications or other specialized applications.

It is an aspect of this invention to provide an improved ignition cable for attenuating interfering high frequencies.

Another aspect is to provide a heat, oxidation, and corrosion resistant ignition cable that also withstands vibration.

Further, it is an aspect of this invention to provide an ignition cable that can be terminated in the field by the user.

Finally, it is an aspect of this invention to provide a cable which is flexible, rugged and reliable in use, has a long service life, and is simple and economical to manufacture.

Other aspects, features and advantages of the present invention will be apparent to those skilled in the art from the following detailed description, particularly when taken in connection with the accompanying drawings.

DETAILED DESCRIPTION

Figure 1:
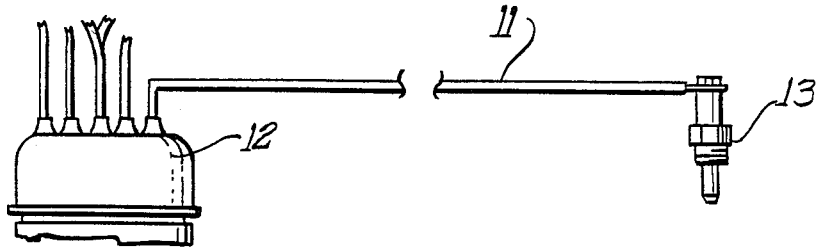
FIG. 1 is an elevation view illustrating part of an ignition system comprising a distributor, an ignition cable and a spark plug.
Figure 2:
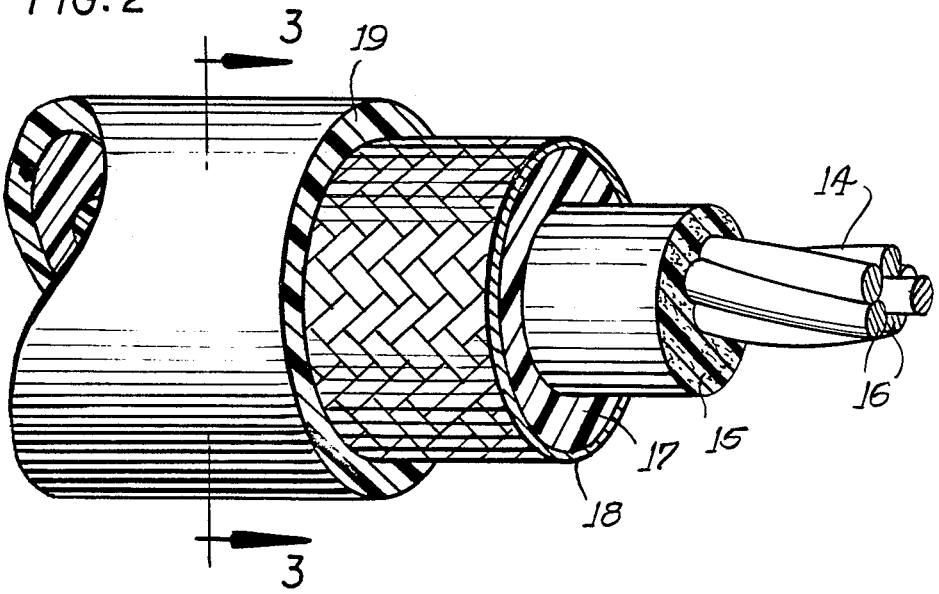
FIG. 2 is an isometric view illustrating an ignition cable of the present invention with components of the cable broken away to show underlying layers and elements.
Figure 3:
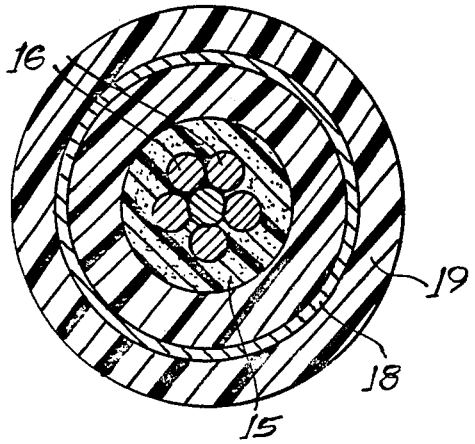
FIG. 3 is a transverse cross-sectional view of the cable shown in FIG. 2, taken along line 3—3 of FIG. 2.

In this description, a cable is defined to mean a conductor with insulation, or a stranded conductor with or without insulation and other coverings. High frequencies are those frequencies (e.g., radio frequencies) which, if not suppressed, will interfere with the proper operation of distant electronic equipment (e.g., radio reception). Semiconductive, as used herein, refers to resistivity (or conductivity) in the range between that of metals and that of insulators and does not refer to other physical properties.

Referring to the drawings, an ignition cable according to the present invention applies ignition current from a source 12 to spark plugs 13. The source illustrated is a conventional distributor connected, in a manner not shown, through an ignition coil and breaker points to a battery or other source of direct current. The ignition cable 11 preferably comprises an inner elongated electrically conductive metallic core 14 of high permeability. The highly permeable material of the core is preferably a highly permeable magnetic alloy such as permalloy or supermalloy. A typical composition (in weight percent) for permalloy is: nickel 79, iron 16.7, molybdenum 4, and manganese 0.3; while a typical composition for supermalloy is: nickel 79, iron 15.7, molybdenum 5, and manganese 0.3. These alloys are heat, oxidation, and corrosion resistant, and they withstand vibration.

A property of highly permeable cores is their relatively high inductance and hence their relatively high impedance that increases with frequency. This impedance increase is the result of skin effect. Skin effect is a phenomenon which occurs in conductors carrying alternating currents, becoming particularly effective at relatively high frequencies. Elements or filaments of a conductor at different points in its cross section do not have the same inductance. The central or axial filament has the maximum inductance, and in general the inductance decreases with the distance from the center of the conductor, becoming a minimum at the surface. Thus, the current is crowded into the outer layer or "skin" of the conductor. Such distribution of the current density produces an increase in the effective resistance, augmented in materials of high permeability.

An electrically semiconductive layer 15, which may be formed of an insulating matrix impregnated with conductive material, is disposed about and in contact with the inner core 14. The insulating matrix is preferably a polymer formed of plastic or rubber, and may be impregnated with metal, metal fibers, metal filings or carbon. This layer 15 has an impedance that is largely resistive and remains relatively constant as the frequency increases.

For direct current and relatively low frequencies the impedance of the inner core 14 is much lower than that of the semiconductive layer 15. At relatively high frequencies the impedance of the inner core 14 is greater than the resistance of the semiconductive layer 15, which is essentially resistive. At intermediate frequencies there is a crossover point where the impedance of the inner core and the resistance of the outer core are substantially equal. The resistance of the inner core 14 is substantially less than the resistance of the semiconductive layer 15. Therefore, the inner core 14 has an impedance at radio frequencies, for example, that is high relative to its direct current resistance, while the semiconductive layer 15 has a resistance that is high relative to the resistance of the inner core 14 for direct current and an impedance that is low relative to the impedance of the inner core at radio frequencies. Thus, direct current is effectively and preferentially conducted by the inner core 14 to provide ignition current, while radio frequency currents are crowded into the semiconductive layer 15 where they are damped, being converted into heat by the resistance thereof to reduce radio frequency interference.

Forming the inner core of a plurality of conductors 16 twisted together increases the inductance of the inner core 14 for crowding out the high frequency currents into the semiconductive layer 15. An embodiment of five conductors twisted around one, and with a tightness of lay (number of turns per inch) of between 1.6 turns/inch and 4 turns/inch would be typical.

Figure 4:
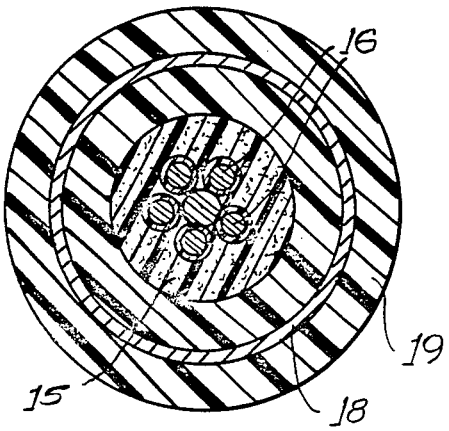
FIG. 4 is a transverse cross-sectional view like FIG. 3, of an alternative embodiment with separately insulated conductors.

In one embodiment of the invention, the five outer conductors are made of the highly permeable material, as is the inner conductor which has sufficient conductivity for the direct current. Alternatively, the inner conductor could be formed of a highly conductive metal of lower permeability such as copper which is less expensive than the highly permeable material. Both embodiments provide the advantages of high conductivity for direct current with high inductance and, thus, high impedance for alternating current, as a result of the highly permeable outer conductors. As shown in FIG. 4, the individual conductors may be insulated from one another, providing increased inductance.

The semiconductive layer 15 can be impregnated with powdered permalloy to increase the inductance of the inner core 14. Although powdered permalloy results in the semiconductive layer 15 having an impedance that increases with frequency, this impedance does not increase as rapidly as the inner core impedance, and the ignition cable will work as previously described.

Insulation is disposed about the semiconductive layer 15. As shown, such insulation may include an initial polymeric insulation layer 17, with optional braided strength members 18, and an outer polymeric jacket 19 impervious to gasoline and oil to protect the cable 11 from its hostile environment in the engine compartment.

In addition, the cable 11 is designed such that it can be terminated in the field by the user. The user first strips off the outer insulation 17, 18, 19, and semiconductive layer 15. The inner core 14 is then folded against the unstripped cable 11. A terminal is put around the folded over core, and the assembly is crimped together to complete this simple termination process. Thus, the ignition cable can be sold in semicustom ignition sets and used for aftermarket applications or other specialized applications.

Various changes may be made in the above constructions within the scope of the present invention. The above description is illustrative of a preferred embodiment.

What is claimed is:

1. An electrical cable that attenuates high frequency currents comprising:

an elongated electrically conductive metallic core of high permeability material; and an electrically semi-conductive layer disposed about said core, the relative resistances and reactances of said core and said layer providing preferential conduction of direct current by said core and providing a greater concentration of high frequency currents into said layer and damping of such high frequency currents by the resistance of said layer, the resistance in respect to direct current of said core in the elongated direction being small relative to the resistance in respect to direct current of said layer in the same direction, and the reactance in respect to high frequency current of said core in said direction being large relative to the reactance in respect to high frequency current of said layer in said direction, the impedance at high frequencies of said layer in said direction being small relative to the impedance at such frequencies of said core in said direction.

2. An electrical cable according to claim 1 wherein said metallic core comprises a central portion of metal of high permeability surrounded by an outer portion of metal of high permeability.

3. An electrical cable according to claim 1 wherein said metallic core comprises a central portion of metal of high conductivity and relatively low permeability surrounded by an outer portion of metal of high permeability.

4. An electrical cable as set forth in claim 1 wherein said semiconductive layer is formed of a polymer impregnated with conductive material.

5. An electrical cable as set forth in claim 1 wherein said core comprises a plurality of metallic conductors of high permeability which are twisted to provide inductance for crowding out high frequency current into said semiconductive layer.

6. An ignition cable for applying ignition current from a source to a spark plug of a spark ignited internal combustion engine and for attenuating radio frequency currents comprising an elongated electrically conductive metallic core for conducting ignition current, said core being formed of high permeability material providing said core with electrical impedance at radio frequencies that is high relative to its direct current resistance;

an electrically semiconductive layer disposed about said core for attenuating radio frequency currents, said layer having an electrical resistance that is high relative to the resistance of said core for direct current and an electrical impedance that is low relative to the impedance of said core at radio frequencies, whereby direct current is effectively and preferentially conducted by said core to provide ignition current, and radio frequency currents are concentrated in said layer where they are damped by the resistance thereof to reduce radio frequency interference.

7. An ignition cable according to claim 6 wherein said metallic core comprises a central portion of metal of high permeability surrounded by an outer portion of metal of high permeability.

8. An ignition cable according to claim 6 wherein said metallic core comprises a central portion of metal of high conductivity and relatively low permeability surrounded by an outer portion of metal of high permeability.

9. An ignition cable as set forth in claim 8 wherein said semiconductive layer is surrounded by insulating means.

10. An ignition cable as set forth in claim 6 wherein said semiconductive layer is formed of a polymer impregnated with conductive material.

11. An ignition cable as set forth in claim 10 wherein said semiconductive layer polymer is impregnated with particulate high permeability material.

12. An ignition cable according to claim 6 wherein said core comprises a plurality of metallic conductors of high permeability which are twisted to provide inductance for crowding out high frequency current into said semiconductive layer.

13. An ignition cable as set forth in claim 12 wherein said twisted conductors are insulated from each other so as to provide inductance for crowding out high frequency currents into said semiconductive layer.

* * * * *